United States Patent [19]

Siegmund

[11] 4,446,002

[45] May 1, 1984

[54] PROCESS FOR SUPPRESSING PRECIPITATION OF SEDIMENT IN UNCONVERTED RESIDUUM FROM VIRGIN RESIDUUM CONVERSION PROCESS

[75] Inventor: Charles W. Siegmund, Morris Plains, N.J.

[73] Assignee: Exxon Research and Engineering Co., Florham Park, N.J.

[21] Appl. No.: 405,314

[22] Filed: Aug. 5, 1982

[51] Int. Cl.[3] ..... C10C 1/00; C10L 1/04; C10L 1/06

[52] U.S. Cl. ..... 208/23; 585/14; 208/48 AA

[58] Field of Search ..... 208/48 AA, 23, 39; 585/14

[56] References Cited

U.S. PATENT DOCUMENTS

| | | | |
|---|---|---|---|
| 1,660,295 | 2/1928 | Goodwin | 208/39 |
| 2,200,484 | 5/1940 | Batchelder | 208/23 |
| 2,315,935 | 4/1943 | Child | 208/39 |
| 2,360,272 | 10/1944 | Plummer | 585/14 |
| 2,755,229 | 7/1956 | Beuther et al. | 208/15 |
| 3,303,122 | 2/1967 | Dollman | 208/23 |
| 3,940,281 | 2/1976 | Corbett | 208/23 |
| 4,207,117 | 6/1980 | Espenscheid et al. | 208/23 |
| 4,231,857 | 11/1980 | Kato et al. | 208/23 |

*Primary Examiner*—Delbert E. Gantz
*Assistant Examiner*—Helane E. Maull
*Attorney, Agent, or Firm*—Janet E. Hasak; Eugene Zagarella, Jr.

[57] ABSTRACT

The precipitation of sediment in the unconverted residuum derived from a virgin residuum conversion process is reduced significantly by blending with the uncoverted residuum an effective amount of a virgin residuum having an asphaltene content of at least about 8% by weight of the virgin residuum at a temperature sufficient to render both residua during blending at a viscosity of no greater than 100 centistokes.

A blend of 1-20% virgin residuum containing at least 8% asphaltene with 80-99% unconverted residuum from a virgin residuum conversion operation, which will contain little, if any sediment, can be used as heavy fuel for power plants.

9 Claims, No Drawings

PROCESS FOR SUPPRESSING PRECIPITATION OF SEDIMENT IN UNCONVERTED RESIDUUM FROM VIRGIN RESIDUUM CONVERSION PROCESS

BACKGROUND OF THE INVENTION

1. Field of the Invention

The present invention relates to a process for suppressing the precipitation of sediment in the unconverted residuum from a virgin residuum conversion process. This invention is also directed to a composition of matter comprising a virgin residuum with high asphaltene content and an unconverted residuum from a conversion process.

2. Description of Related Patents

Petroleum crude oil is generally separated into constituent fractions having separate boiling points by atmospheric distillation at temperatures of about 675°—725° F. (357°-385° C.) so as to obtain distillate products such as gasoline, with a heavy residue remaining as bottoms product, commonly referred to as virgin residuum. The virgin residuum, in turn, may be subjected to further treatment, e.g., a thermal cracking operation commonly known as visbreaking or a catalytic conversion process such as hydrocracking or cat cracking, to obtain additional converted distillate products from the crude oil. The thermally cracked residual components contained in the unconverted residuum remaining from the cracked operation tend to be incompatible with other distillate or residual components and to precipitate asphaltenes as sediment when blended therewith.

Such precipitation has traditionally been prevented by limiting the amount of conversion in the visbreaker, thereby reducing yields of desirable product. An alternative method is to add highly aromatic flux stocks, which are highly cracked stocks without asphaltenes, to the unconverted residuum, as, for example, taught by U.S. Pat. No. 2,360,272, which uses, e.g., the heavy fraction from catalytic hydroforming or the heavy cycle oil from cat cracking.

U.S. Pat. No. 2,755,229 describes a method of stabilizing visbroken residuum of petroleum crudes by adding any virgin residuum thereto, with the minimum total volume of virgin stock and cutter oil added being approximately equal to the volume of unstable vibroken fuel oil.

SUMMARY OF THE INVENTION

It has now been discovered that the precipitation of sediment in the unconverted residuum obtained from a virgin residuum conversion process can be suppressed by blending with the unconverted residuum an effective amount of a virgin residuum having an asphaltene content of at least about 8% by weight of the virgin residuum at a temperature sufficient to maintain both residuum components at a viscosity of no greater than about 100 centistokes during blending. It is unexpected that such a high asphaltene content would reduce sedimentation of asphaltenes in the unconverted residuum, because materials with a high asphaltene and high sulfur content are not conventionally added as a blending ingredient. By this process the extent of conversion can be maximized while at the same time the amount of sediment obtained is reduced.

Another aspect of this invention is a stabilized blend, as a composition of matter, of about 1-20%, preferably about 5-10%, by weight of a virgin residuum containing at least 8% asphaltene by weight and about 80-99%, preferably about 90-95%, by weight of the unconverted residuum. This blend may be used, for example, as a heavy fuel for power plants and other operations wherein use of heavy fuel oils is desired.

DESCRIPTION OF THE PREFERRED EMBODIMENTS

As used herin, the term "virgin residuuM" generally refers to the residuum obtained from distillation of crude oil at about 675°-725° F. (357°-385° C.), which residuum has not been thermally cracked or otherwise converted.

As used herein, the term "unconverted residuum" refers to the residue (bottoms) remaining after subjecting a virgin residuum to a thermal conversion process such as visbreaking or to a catalytic conversion process such as hydrocracking or cat cracking. The extent of visbreaking may be measured by the yield of gasoline and distillate obtained, with a higher yield of gasoline and distillate resulting in a more unstable unconverted residuum due to the greater presence of cracked material. It is noted that the unconverted residuum may also be a mixture of residues from cracking different crude oils if desired.

The virgin residuum employed as an additive in the present invention must have a high asphaltene content, i.e., it contains at least 8% by weight of asphaltenes so as to exhibit the solvency for the sediment in the unconverted residuum which is desired for a particular application. There is a balance, however, as to the maximum amount of asphaltenes which may be present in the virgin residuum because, while greater amounts reduce sediment levels, they also increase the amount of particulates emitted when the fuel oil is burned so that emissions standards may be exceeded. Preferably, the amount of asphaltenes in the virgin residuum will range from about 9 to about 35% by weight, depending on the asphaltene content in the crude oil from which the residuum is obtained and the amount of sediment to be reduced in the unconverted residuum.

Virgin residuum with the high asphaltene content required by this invention may be obtained, for example, by a solvent deasphalting process wherein a virgin residuum is mixed with a light paraffin such as propane which causes the residuum to separate into two phases. One phase is essentially free of asphaltenes while the other phase, which is the one which may be employed in the process herein, contains a high concentration of virgin asphaltenes. Such a residuum is designated herein as a virgin asphalt phase residuum.

Another way to obtain a virgin residuum with high asphaltene content is to heat the crude oil at atmospheric pressure up to about 675°-725° F. (357°-385° C.) to obtain a virgin atmospheric residuum, which is then subjected to a vacuum to reduce the pressure to as low as possible, e.g., 20 mm Hg, so as to produce more distillates. In so doing, the asphaltenes are further concentrated in the virgin residuum. Such a concentrated residuum is designated herein as a virgin vacuum residuum.

In the process herein described, the level of precipitated sediment in the unconverted residuum is reduced by blending it with a virgin residuum as described above in an amount effective to suppress the precipitation of sediment. Typically, this amount is from 1 to 20% by weight of the total blend, depending primarily on the types of crude oil from which the residua are obtained, with particular reference to their asphaltene contents. Preferably, this amount is from about 5 to 10% by weight.

The blending itself is conducted at atmospheric pressure at a temperature sufficient to maintain both residuum components during blending in a flowable state, i.e., at a viscosity of no greater than 100 centistokes, preferably no greater than 80 centistokes, for a period of time necessary to obtain sufficient blending of the ingredients. In a typical process the blending is conducted at about 215°-260° F. (102°-127° C.), depending on the particular crude oils being utilized. Temperatures outside this range may be necessary to render the components sufficiently flowable so as to obtain complete mixing and to suppress precipitation. It is noted that any suitable equipment can be employed to effect blending of the residua.

In the examples which follow, illustrating the efficacy of the invention, the asphaltene content of the virgin residuum was measured by the British Institute of Petroleum procedure identified as IP-143, which essentially measures the amount of material (asphaltenes) in the virgin residuum which is insoluble in n-heptane. The amount of sediment produced was determined by hot filtration of the blend and weighing of the sediment retained on the filter. In the examples, all percentages are by weight unless otherwise noted.

EXAMPLE 1

Three blends designated A, B and C were prepared by mixing together the indicated proportions of the indicated residua for one hour at about 250° F. (121° C.). The blends and the amount of sediment measured for each blend are indicated in Table I.

TABLE I

| | Blends | | |
|---|---|---|---|
| | A (control) | B | C |
| Residua (weight %): | | | |
| Dunlin Thistle Visbroken (Unconverted) Tar | 70 | 69 | 67 |
| Brent Atmospheric (Unconverted) Residuum | 30 | 29 | 29 |
| Iranian Light Vacuum (Virgin) Residuum (9% by weight asphaltene) | 0 | 2 | 4 |
| Amount of Sediment (% by weight of total blend): | 0.19 | 0.11 | 0.05 |

It can be seen from the data that the higher the amount of virgin residuum added the lower the amount of sediment produced. It is noted that levels considered desirable in commercial fuel oils are about 0.1% or less.

EXAMPLE 2

Three blends designated D, E and F were prepared by mixing together the indicated proportions of the ingredients for one hour at about 250° F. (121° C.). The blends and the amount of sediment measured for each blend are indicated in Table II.

TABLE II

| | Blends | | |
|---|---|---|---|
| | D (control) | E | F |
| Residua (weight %): | | | |
| Dunlin Thistle Visbroken (Unconverted) Tar | 70 | 69 | 67 |
| Brent Atmospheric (Unconverted) Residuum | 30 | 29 | 29 |
| Asphalt Phase (Virgin) Residum Obtained by Solvent Deasphalting Process (15.9% by weight asphaltene) | 0 | 2 | 4 |
| Amount of Sediment (% by weight of total blend): | 0.25 | 0.13 | 0.06 |

The results as compared with those from Example 1 indicate that the higher asphaltene content in the virgin residuum more greatly reduces sediment in the blend relative to the control on adding only 2% of the virgin residuum to the unconverted residuum.

In summary, the present invention provides a process for suppressing precipitation of sediment in the unconverted residuum from a virgin residuum conversion process whereby a virgin residuum of high asphaltene content is added thereto.

While the invention has been described in connection with specific embodiments thereof, it will be understood that it is capable of further modification, and this application is intended to cover any variations, uses, or adaptations of the invention, following, in general, the principles of the invention and including such departures from the present disclosure as come within known or customary practice in the art to which the invention pertains and as may be applied to the essential features hereinbefore set forth, and as fall within the scope of the invention.

What is claimed is:

1. A process for suppressing the precipitation of sediment in the unconverted residuum obtained from conversion of virgin residuum comprising blending with the unconverted residuum an effective amount of a virgin residuum having an asphaltene content of at least about 8% by weight of the virgin residuum at a temperature sufficient to maintain both the virgin and the unconverted residua during blending at a viscosity of no greater than 100 centistokes.

2. The process of claim 1 wherein 1 to 20% by weight of said virgin residuum of at least 8% asphaltene content is blended with said unconverted residuum.

3. The process of claim 1 wherein 5 to 10% by weight of said virgin residuum of at least 8% asphaltene content is blended with said unconverted residuum.

4. The process of claim 1 wherein said virgin residuum blended with said unconverted residuum contains about 9-35% by weight of asphaltene.

5. The process of claim 1 wherein the blending is carried out at 215°-260° F. (102°-127° C.).

6. The process of claim 1 wherein said virgin residuum of at least 8% asphaltene content is obtained from a solvent deasphalting process or from a vacuum residuum.

7. A composition of matter comprising a blend of about 1-20% by weight of a virgin residuum containing at least 8% by weight of asphaltene and about 80-99% by weight of an unconverted residuum from conversion of virgin residuum.

8. The composition of claim 7 comprising a blend of about 5-10% by weight of said virgin residuum of at least 8% asphaltene content and about 90-95% by weight of said unconverted residuum.

9. The composition of claims 7 or 8 wherein the asphaltene content is 15-35% by weight.

* * * * *